US006318278B1

(12) United States Patent
Dugue et al.

(10) Patent No.: US 6,318,278 B1
(45) Date of Patent: Nov. 20, 2001

(54) PROCESS FOR CALCINING AN ORE-BASED MATERIAL

(75) Inventors: Jacques Dugue; Thierry Borissoff; Ovidiu Marin; Ivan Milosavljevic; Dora Sophia Alves; Michel Viardot, all of Paris Cedex (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/599,217

(22) Filed: Jun. 22, 2000

(30) Foreign Application Priority Data

Jul. 2, 1999 (FR) ..... 99 08561

(51) Int. Cl.[7] ..... F23L 9/00

(52) U.S. Cl. ..... 110/348; 110/346; 110/297; 110/233; 110/246; 110/345; 432/106

(58) Field of Search ..... 106/741; 432/58, 432/103, 106, 14, 226, 227, 233; 110/226, 227, 233, 246, 297, 342, 346, 348, 345

(56) References Cited

U.S. PATENT DOCUMENTS 4,045,162 * 8/1977 Christiansen ..... 432/14
4,187,071 2/1980 Brachthauser et al. .
4,226,586 * 10/1980 Brachthauser et al. ..... 432/106
4,248,639 * 2/1981 Quittkat ..... 106/100
4,353,750 10/1982 Quittkat .
4,560,412 12/1985 Weber .
5,098,285 * 3/1992 Bauer ..... 432/14
5,572,938 * 11/1996 Leger ..... 110/346
5,816,795 10/1998 Hansen et al. .
6,077,072 * 6/2000 Marin et al. ..... 432/105
6,116,896 * 9/2000 Joshi et al. ..... 432/117
6,176,187 * 1/2001 Leonard et al. ..... 110/215
6,196,831 * 3/2001 Dugue et al. ..... 431/8
6,210,154 * 4/2001 Evans et al. ..... 432/106
6,241,514 * 6/2001 Joshi et al. ..... 432/105

* cited by examiner

*Primary Examiner*—Henry Bennett
*Assistant Examiner*—K. B. Rinehart
(74) *Attorney, Agent, or Firm*—Burns, Doane, Swecker & Mathis, L.L.P.

(57) ABSTRACT

In this process the material is passed through a precalcination device equipped with at least one fuel injector at the outlet of which a fuel injection zone is formed, then the at least partially calcined material is passed into the rotary kiln which at its downstream end, is equipped with a primary combustion unit. At least one oxygen rich fluid with an oxygen concentration by volume higher than that of the products of combustion from the rotary kiln is injected near to the injection zone so that the oxygen rich fluid can supply from 1% to 40%, and preferably form 1 to 10% of the stoichiometric amount of oxygen needed for the combustion of the fuel injected by the injector.

54 Claims, 7 Drawing Sheets

PROCESS FOR CALCINING AN ORE-BASED MATERIAL

BACKGROUND OF THE INVENTION

1. Field of the Invention

The invention relates to a process for calcining an ore-based material, in which process:

the material is passed through a precalcination device equipped with at least one fuel injector supplied with at least one fuel so as to form a fuel-injection zone at the outlet of the fuel injector and supplied with oxidizing agent by the products of combustion from a rotary kiln located downstream of the precalcination device with respect to the direction in which the material flows, then the at least partially calcined material is passed into the rotary kiln which, at its downstream end, is equipped with a primary combustion unit.

2. Description of the Related Art

The manufacture of cement passes through an intermediate stage involving the manufacture of a product known as clinker. Clinker is a product which is obtained by firing ore-based material, particularly clay and limestone. The material, in the form of a powder, may be supplied to a rotary kiln either in dry form (in a dry process) or in the form of a water-based paste (or slurry) (wet process). The composition of the clinker is generally carefully controlled in order to obtain the desired proportions of the various inorganic materials, particularly calcium carbonate, silica, alumina, iron oxide and magnesium carbonate. After being placed in a kiln, the material that is the precursor to the manufacture of clinker is first of all dried out and heated. Next, this material undergoes calcination in which the carbonates of the various minerals are converted into the oxides of these minerals by the removal of carbon dioxide. While the temperatures are still high, the minerals thus obtained react chemically with each other to essentially produce calcium silicates and calcium aluminates. This last process is known as the clinkering process and takes place in the hot zone of a rotary kiln. The resulting clinker is then cooled and ground then mixed with additional ingredients to form a cement such as portland cement.

The clinker-manufacturing process has, in the past, been performed in rotary kilns which typically have diameters of 3 to 5 m and lengths of 60 to 200 m. Improvements to the process have been made by decarburizing or calcining a variable fraction of the raw meal in a stage in the process preceding the rotary kiln, allowing the use of shorter and more thermally efficient rotary kilns. A process stage such as this may be performed in preheater towers (or suspension preheaters), in LEPOL grates or in flash calcination devices.

The extent to which the raw meal is decarburized before it enters the rotary kiln is typically 10 to 45% in the case of suspension preheaters and LEPOL grates and 90 to 95% in the case of flash calcination devices. The energy required for the highly endothermic decarburization stage is supplied by introducing a fraction of fuel into the calcination zone.

Thus, processes for the manufacture of clinker are generally carried out in plants which comprise, in succession:

a precalcination device into which the material is introduced and in which drying-out, if necessary, then heating and some of the calcination of the material are carried out, and an inclined rotary kiln into which the partially calcined material is introduced and in which calcination is completed, followed by the clinkering reaction.

Types of precalcination device other than those mentioned hereinabove may be calcination chambers or devices known by the name of riser ducts.

In all that follows, the terms "upstream" and "downstream" are to be understood as being with respect to the direction in which the material in such a plant flows.

One or more burners are arranged at the downstream end of the rotary kiln to supply the calorific energy needed for this kiln to operate. The flue gases produced by the burners downstream of the rotary kiln flow against the flow of the material in the plant and supply some of the calorific energy needed for the operation of the precalcination device. Additional energy is provided to this precalcination device by one or more burners.

In general, the search is on to limit the cost of the manufacture of clinker and to improve the processes used for the manufacture of clinker.

Hence, documents U.S. Pat. Nos. 5,572,938 and 5,580,237 relate to the burners downstream of the rotary kilns and propose that the injectors of these burners be modified so that oxygen-injection lances can be introduced thereto. The solutions described in these documents make it possible, with high-quality fuel, to improve the production efficiencies and/or reduce the production of pollutants.

However, these solutions still lead to the emission of relatively significant pollutants.

Elsewhere, the search is on to use low-quality fuels for supplying the calorific energy needed for the operation of clinker-manufacturing plants.

Low-quality fuels are to be understood as meaning fuels which have net calorific values (NCVs) lower than 15 MJ/kg, or water content by mass in excess of 20%. This category also covers fuels which contain less than 20% by mass of volatilizable substances or substances which cannot be reduced to small-sized particles or droplets. In respect of this last criterion, a fuel thus reduced, in which the proportion by mass of particles or droplets of a size exceeding 200 $\mu$m is greater than 75%, is considered as being a low-quality fuel.

Industrial waste, such as waste water or solid waste, for example of plastics or cardboard, constitutes low-quality fuels that can be used in the manufacture of clinker.

Clinker manufacturers are looking to increase their consumption of low-quality fuels given their very low costs, these manufacturers even sometimes being paid to incinerate industrial waste such as waste water.

However, the use of such fuels in large quantity poses problems because the flames produced with these fuels are unable to meet the thermal constraints required in the correct implementation of clinker-manufacturing processes.

The object of the invention is to solve these various problems by providing a process for calcining an ore-based material which, in particular, allows the manufacture of clinker at low cost, particularly using low-quality fuels, while at the same time limiting the emission of pollutants.

SUMMARY OF THE INVENTION

To this end, the subject of the invention is a process for calcining an ore-based material in which the material is passed through a precalcination device equipped with at least one fuel injector supplied with at least one fuel so as to form a fuel-injection zone at the outlet of the fuel injector and supplied with oxidizing agent by the products of combustion from a rotary kiln located downstream of the precalcination device with respect to the direction in which the material flows, then the at least partially calcined material is passed into the rotary kiln which, at its downstream end, is equipped with a primary combustion unit, wherein at least one oxygen-rich fluid is injected near to the fuel-injection zone, the oxygen rich fluid having an oxygen concentration by volume that is higher than that of the products of combustion from the rotary kiln and which pass through the precalcination device, so that the oxygen-rich fluid can supply from 1% to 40%, and preferably from 1% to 10%, of the stoichiometric amount of oxygen needed for the combustion of the fuel injected by the fuel injector.

According to some particular embodiments, the process may exhibit one or more of the following features, taken in isolation or in any technical feasible combination:

60% to 99% of the stoichiometric amount of oxygen needed for the combustion of the fuel are provided by the products of combustion from the rotary kiln;

the oxygen concentration by volume of the products of combustion from the rotary kiln is greater than or equal to 1%;

the oxygen-rich fluid is a mixture of some of the products of combustion and a gas containing at least about 20% oxygen;

some of the products of combustion are drawn off and air or oxygen-enriched air and/or industrially pure oxygen with a concentration higher than about 88% is mixed with them;

the adiabatic temperature of the flame produced at the outlet of the fuel injector is higher than 1000° C.;

the adiabatic temperature of the flame produced at the outlet of the fuel injector is higher than 1250° C.;

the fuel with which the fuel injector is supplied is a low-quality fuel;

said oxygen-rich fluid is injected using an oxygen-rich-fluid injector which is distinct from the fuel injector;

the distance between the outlet of said oxygen-rich-fluid injector and the outlet of the fuel injector is less than about 50 times the interior width of the oxygen-rich-fluid injector;

an oxygen-rich fluid is injected toward the fuel-injection zone of the fuel injector;

the fuel is injected using the fuel injector and the oxygen-rich fluid is injected at an angle of convergence of less than 25°;

the precalcination device comprises at least two fuel injectors which are supplied respectively with at least one fuel to form a fuel-injection zone at its outlet and at least one oxygen-rich fluid with an oxygen concentration by volume that is higher than that of the products of combustion from the rotary kiln is injected near to the fuel-injection zones of said at least two fuel injectors;

at least one oxygen-rich fluid with an oxygen concentration by volume higher than that of the products of combustion from the rotary kiln is injected by means of a fuel injector belonging to the precalcination device;

said oxygen-rich fluid is used as a carrier fluid for carrying a fuel into said fuel injector;

an oxygen-rich fluid is oxygen with a purity greater than 90% that is passed through said fuel injector via an oxygen-specific passage;

a high-quality fuel is introduced through a passage of said fuel injector near to an oxygen-specific passage so as to form a pilot flame at the outlet of said fuel injector;

at least one or each oxygen-rich fluid is oxygen-enriched air;

at least one oxygen-rich fluid has an oxygen concentration higher than 90%;

an oxygen-rich fluid with an oxygen concentration higher than that of air is injected into a fuel-injection zone of the primary combustion unit of the rotary kiln (FIGS. 2 and 4 to 7);

the oxygen-rich fluid is introduced inside a fuel injector belonging to the primary combustion unit of the rotary kiln;

the oxygen-rich fluid is oxygen with a purity greater than 90% that is passed through said fuel injector via an oxygen-specific passage;

an oxygen-specific passage is located radially on the inside of said fuel injector;

an oxygen-specific passage is located radially on the outside of said fuel injector;

a passage of said fuel injector near to an oxygen-specific passage is used to introduce at least one high-quality fuel so as to form a pilot flame at the outlet of said fuel injector;

at least one fuel flow and at least one air flow are produced in said fuel injector and at least one air flow and/or fuel flow produced in said fuel injector is enriched with oxygen (FIGS. 2 and 4);

a fuel flow is produced in said fuel injector by introducing a fuel and a carrier fluid for this fuel into the fuel injector, and this fuel flow is enriched with oxygen by enriching the carrier fluid with oxygen;

said fuel is introduced into said injector in the form of a fluid;

said fuel is introduced into said injector in the form of solid particles;

the carrier fluid is enriched with oxygen until it has an oxygen concentration that may be as high as 35%;

said fuel is a low-quality fuel;

oxygen is introduced into the fuel-injection zone of the primary combustion unit of the rotary kiln with a flow rate of between 2 and 20 $m^3/h$ (STP) per MW of theoretical power supplied by a complete combustion of the fuel(s) injected by the primary combustion unit; and the calcination process is a process for the manufacture of clinker.

BRIEF DESCRIPTION OF THE FIGURES OF THE DRAWING

The invention will be better understood from reading the description which will follow, which is given merely by way of example and made with reference to the appended drawings, in which.

DETAILED DESCRIPTION OF THE PREFERRED EMBODIMENT

Figure 1:
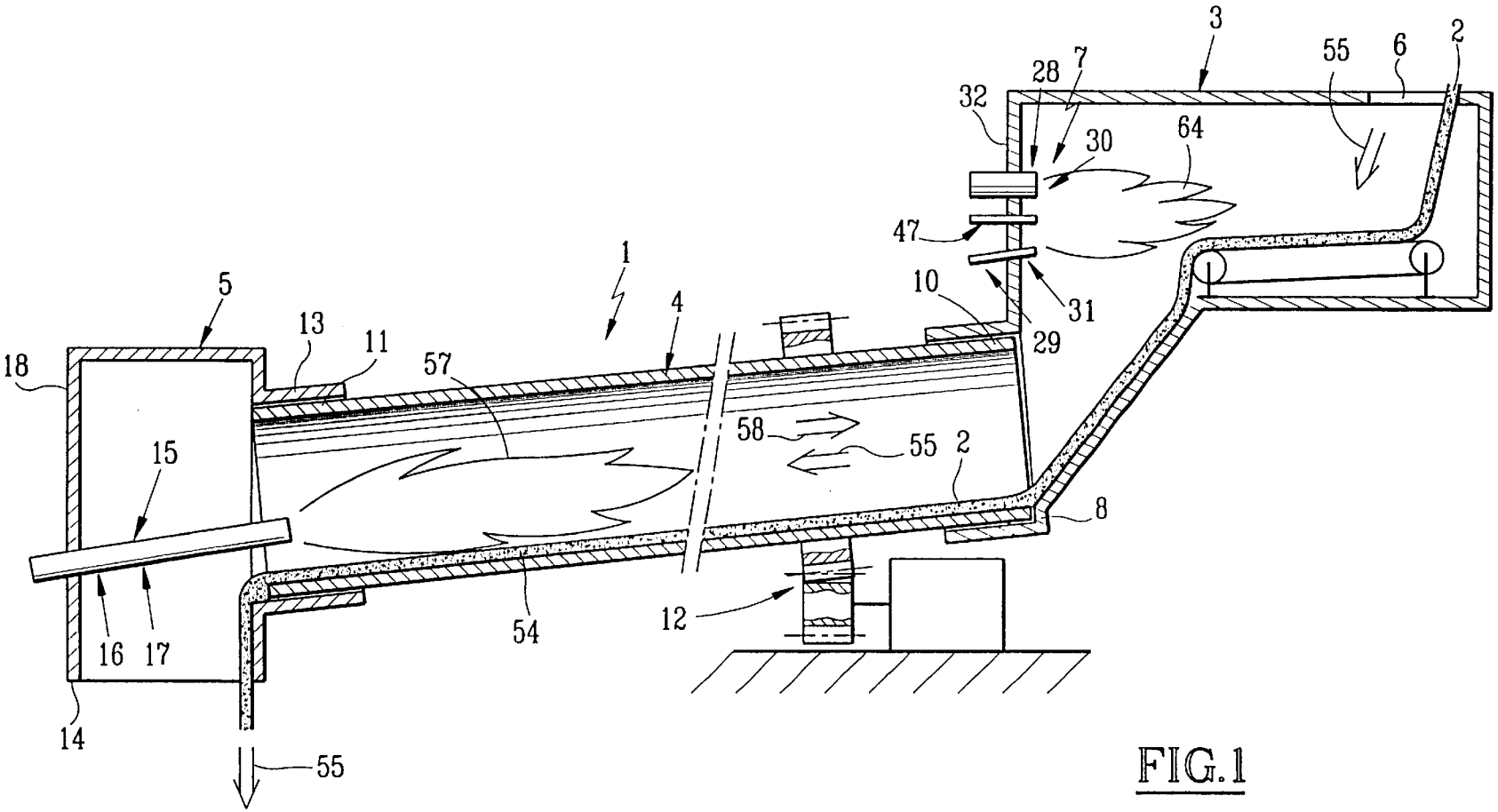
FIG. 1 is a diagrammatic view in lateral section of a clinker-manufacturing plant for the implementation of a process according to the invention.

FIG. 1 illustrates a plant 1 for producing clinker from a material 2 based, in particular, on limestone and clay.

The plant 1 comprises, in succession, and in the direction in which the material 2 flows:

a precalcination device 3, a rotary tubular kiln 4, and an outlet chute 5.

The precalcination device 3 may, for example, be a LEPOL grate and comprises an upstream end 6 at which the material 2 is introduced, heating means 7 or combustion unit, and a downstream end 8 at which the precalcined material is discharged.

The rotary kiln 4 is inclined, with respect to the horizontal, downward from the upstream end towards the downstream end. Its upstream end 10 which communicates with the downstream end 8 of the precalcination device 3 is therefore located higher up than its downstream end 11.

The plant 1 also comprises means 12 for rotating the rotary kiln 4 about its longitudinal axis.

The outlet chute 5 has an upstream end 13 which communicates with the downstream end 11 of the rotary kiln 4, and a downstream end 14 connected to devices, not depicted, for subsequent processing of the clinker produced, including, in particular, a cooling device.

The outlet chute 5 is also equipped with heating means 15 or with a primary combustion unit.

Figure 2:
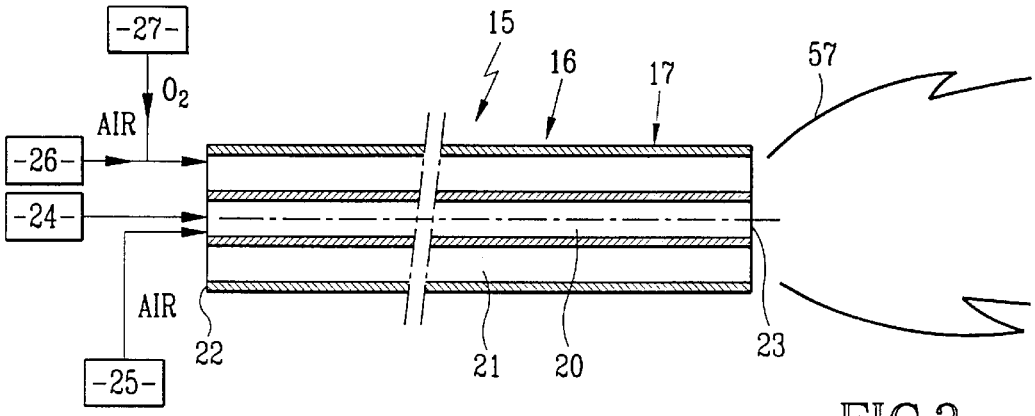
FIG. 2 is an enlarged diagrammatic view in longitudinal section of the primary combustion unit of the rotary kiln of the plant of FIG. 1.

As illustrated by FIG. 2, these heating means 15 comprise burners 16, just one of which has been depicted and just one of which will be described.

The burner 16 comprises an injector or blast pipe 17 borne by a vertical wall 18 of the outlet chute 5, the vertical wall 18 being placed facing the downstream end 11 of the rotary kiln 4 as seen in FIG. 1.

The injector 17 runs parallel to the axis of the rotary kiln 4 from the wall 18, entering the downstream end 11 of the rotary kiln 4.

The injector 17 has an inner passage 20 of circular cross section surrounded on its outside by an outer passage 21 of annular cross section. The injector 17 has an inlet 22 and an outlet 23.

The passage 20 is, at the inlet 22 of the injector 17, connected both to a source 24 of fuel and to a source 25 of carrier fluid for this fuel.

The fuel is, for example, plastic shredded into particles the size of which may exceed 5 or 10 mm, that is to say a low-quality fuel. The carrier fluid is, for example, pressurized air.

The outer passage 21 is connected, at the inlet 22 of the injector 17, by a common pipe to a source 26 of oxidizer, for example air, and to a source 27 of oxygen.

The purity of the oxygen from the source 27 is, for example, greater than 90%.

Figure 3:
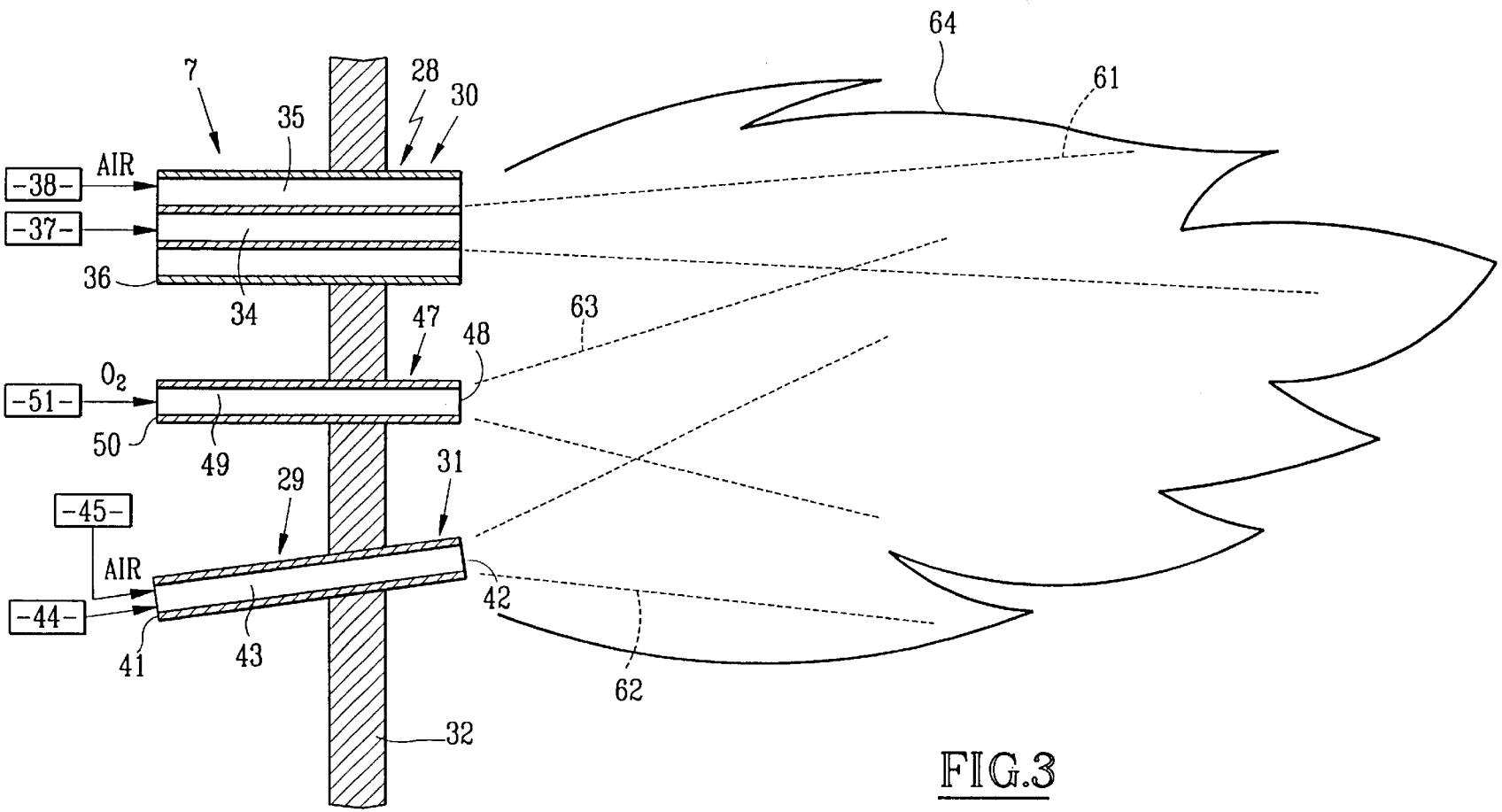
FIG. 3 is an enlarged diagrammatic view in longitudinal section of the combustion unit of the precalcination device of the plant of FIG. 1.

As illustrated by FIG. 3, the means 7 for heating the precalcination device 3 comprise burners, two of which have been depicted and bear the references 28 and 29. Only these burners 28 and 29 and their immediate surroundings will be described in what follows.

The burners 28 and 29 each comprise an injector, 30 and 31 respectively. The injectors 30 and 31 are borne by a vertical wall 32 of the precalcination device 3. This vertical wall 32 is arranged above the upstream end 10 of the rotary kiln 4, as can be seen in FIG. 1.

The injector 30 is arranged with its axis substantially horizontal and comprises an inner passage 34 of circular cross section surrounded on the outside by an outer passage 35 of annular cross section.

The inner passage 34 is connected, in the region of the inlet 36 of the injector 30, to a source 37 of fuel, for example natural gas, which is a high-quality fuel.

The outer passage 35 is connected, in the region of the inlet 36 of the injector 30, to a source 38 of oxidizer, for example air.

The injector 31 is arranged below the injector 30 and is inclined in a vertical plane upward from its inlet 41 towards its outlet 42, at an angle preferably smaller than 25°. This injector 31 comprises an interior passage 43 of circular cross section connected, in the region of the inlet 11 of the injector 31, both to a source 44 of fuel and to a source 45 of carrier fluid for this fuel.

The fuel from the source 44 consists, for example, of waste water, and the carrier fluid is, for example, pressurized air.

The heating means 7 further comprise a lance 47 for injecting oxygen, which lance is also borne by the wall 32.

The lance 47 is located between the injectors 30 and 31 and its axis is horizontal. This lance 47 is arranged, on the one hand, near the injector 30 and, on the other hand, near the injector 31, so that the distance between the outlet 48 of the lance 47 and the outlet 42 of the injector 31 is less than 50 times the diameter of the interior passage 49 of the lance 47.

Incidentally, the passage 49 of the lance 47 is connected in the region of the inlet 50 of the lance 47 to a source 51 of oxygen.

The purity of the oxygen of the source 51 is, for example, higher than 90%.

The overall operation of the plant 1 will now be described, the direction of flow of the material 2 being symbolized by the arrows 55 in FIG. 1.

The material 2 is introduced via the upstream end 6 of the precalcination device 3. Inside this device, the material 2, conveyed by a conveyor, is dried, heated and decarburized by virtue, in particular, of the heating means 7 which supply some of the required calorific energy.

Next, the material 2 flows through the downstream end 8 of the precalcination device 3 and through the upstream end 10 of the rotary kiln 4, then into the rotary kiln 4 in the form of a bed 54.

Decarburizational calcination of the material 2 continues in the rotary kiln 4 as a result of the heating means 15, and the calcined material 2 then undergoes the clinkering reaction.

The material 2 converted into hot clinker is then removed via the downstream end 14 of the chute 5 to the other devices of the plant 1 including the cooling device.

The supply of calorific energy to the inside of the kiln 4 and of the precalcination device 3, as obtained from the heating means 7 and 15, will now be more especially described.

As far as the heating means 15 are concerned, the fuel from the source 24 is introduced into the inner passage 20 together with the pressurized air from the source 25. Thus, a flow of solid plastic particles is produced in the inner passage 20. The fuel from the source 24 is then sprayed out in the form of solid particles at the outlet 23 of the injector 17.

The air from the source 26 is enriched with oxygen by the source 27 and then flows through the passage 21. This oxygen-enriched air is ejected from the outlet 22 of the injector 17 in the form of a stream which externally surrounds the sprayed-out fuel from the source 24. A flame 57 is therefore produced at the outlet of the burner 16. The oxygen-enriched air from the source 26 provides most of the oxidizer needed for the corresponding combustion. This flame 57 is located above the bed 54 of material 2, in the region of the downstream end 11 of the rotary kiln 4, as can be seen in FIG. 1.

The flue gases produced by the flame 57 travel through the rotary kiln 4 and into the precalcination device 3 against the flow of the material 2, as symbolized by the arrow 58 in FIG. 1.

As far as the heating means 7 are concerned, the natural gas is ejected from the injector 30 in an injection zone 61 in the form of a jet of fuel surrounded by a stream of air from the source 38.

The waste water from the source 44 is introduced together with the pressurized air from the source 45 into the passage 41 of the burner 29 to form a jet of waste water sprayed out in the form of fine droplets in an injection zone 62.

The oxygen from the source 51 is introduced into the passage 49 and ejected from the injector 47 in the form of a jet in an injection zone 63 which partially overlaps the injection zones 61 and 62.

Thus, the oxygen jet impinges on the jet of sprayed-out waste water and the jet of natural gas surrounded by the stream of air from the source 38.

A flame 64 is produced in the zones 61, 62 and 63, as a result of the combustion:

- of the waste water from the source 44 with the air from the sources 38 and 45 and the oxygen from the source 51, and also
- of the unburnt matter from the heating means 15 conveyed by the flue gases traveling in the direction of the arrow 58 and of the oxygen contained in these flue gases from the heating means 15.

The combustion efficiency of the waste water from the source 44 is satisfactory because this waste water and the oxygen from the source 51 are injected close together.

What happens is that this injection of oxygen creates a hot spot near the zone 62 at which the waste water is injected, and this makes it possible, by bringing the waste water quickly up to its ignition temperature, to stabilize the combustion and thus more easily control the supply of calorific energy to the precalcination device 3.

Moreover, because of the proximity of the zone 63 at which the oxygen from the source 51 is injected to the zone 61 at which the fuel from the source 37 is injected, the unburnt matter from the heating means 15 is burnt up. The amounts of unburnt matter discharged by the plant 1 are therefore reduced.

More generally, the supply of oxygen by the lance 47 makes it possible:

- either to increase the amount of waste water incinerated for the same fuel flow rate from the source 37 and for the same combustion temperature,
- or to reduce the amount of unburnt matter carried along by the flue gases discharged at the upstream end 6 of the precalcination device 3, this result being obtained for the same flow rates of fuel from the source 37 and waste water from the source 44.

In the plant of FIGS. 1 to 3, these effects are obtained jointly on account of the proximity of the lance 47 both to the injector 30 and to the injector 31.

In order more particularly to encourage the incineration of waste water, the lance 47 has to be located in proximity to the injector 31 in which the waste water is introduced, whereas to encourage the reduction in the amount of unburnt matter, the oxygen-injection lance 47 has to be brought closer to the injector 30 in which the high-quality fuel is introduced.

What is more, enriching the carrier air used in the injector 17 of the heating means 15 with oxygen also makes it possible:

- to increase the combustion efficiency of the fuel from the source 24 at the outlet of the burner 16 and thus reduce the amount of unburnt matter produced by this burner 16, and
- to stabilize the flame 57 produced by this burner 16 while at the same time using the low-quality fuel from the source 24.

These effects are due to the fact that the oxygen introduced allows the fuel from the source 24 to be brought quickly up to its ignition temperature.

It is also noted that the injection of oxygen by enriching the air of the source 26 makes it possible to shorten the flame and therefore the high-temperature firing zone in the rotary kiln 4. As a result, the alite and belite crystals that constitute the clinker produced are far smaller than they would be in the absence of injection of oxygen.

For example, the dimensions can be reduced by 5 $\mu$m in the case of alite crystals and by 2 $\mu$m in the case of belite crystals by introducing about 7.6 $m^3$ (STP) of oxygen per tonne of clinker produced. It is also found that the levels of free lime present in the clinker produced are reduced by 1.7% on average with the over-oxygenation according to the process described, as compared to 2.9% without over-oxygenation.

Thus, the cement produced from such clinker has higher short-term and medium-term strength. For example, a 1.5 MPa increase in the short-term strength and a 2.5 MPa increase in the medium-term strength of such a cement may be observed.

It will be noted that the burner 16 is a conventional burner which did not need to be modified for over-oxygenating the flame 57 it produces.

Thus, the process described makes it possible to reduce clinker-manufacturing costs particularly by using relatively high quantities of low-quality fuels while at the same time observing the constraints on heat exchange in the plant 1 and limiting the emission of pollutants.

Figure 4:
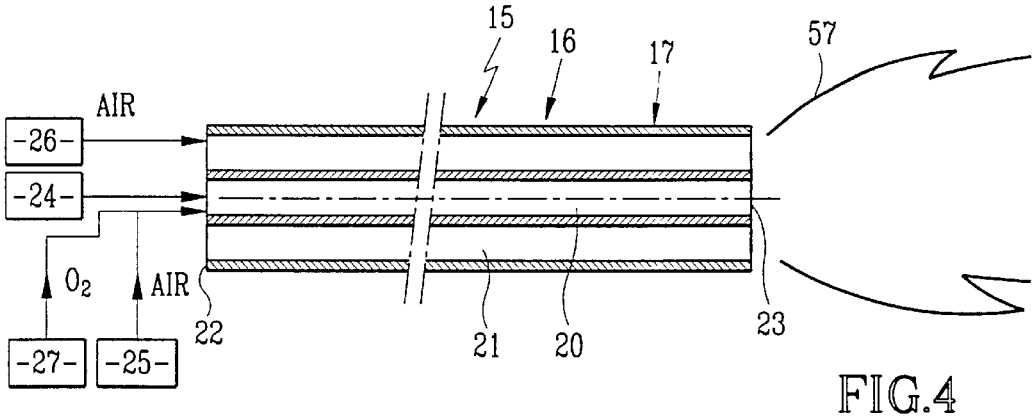
FIGS. 4 to 7 are views similar to FIG. 2, illustrating other embodiments and alternative forms of the invention.

According to an alternative form of the heating means 15, and illustrated in FIG. 4, the inner passage 20 of the injector 17 is connected both to the source 24 and to a common outlet pipe for the carrier air source 25 and oxygen source 27.

Thus, in this alternative form, it is the carrier air for the fuel from the source 24 which is enriched with oxygen before being introduced into the injector 17 to over-oxygenate the flame 57.

According to other alternative forms which have not been depicted, the carrier fluid from the source 25 and the air from the source 26 can be enriched with oxygen. Furthermore, this enrichment may be carried out inside the injector 17, the fluid that is to be enriched with oxygen and the oxygen being introduced separately into the injector 17 rather than being introduced simultaneously as described hereinabove.

In general, the oxygen-enriched fluid and, in particular, the fuel carrier fluid, may be enriched to such a point that they have an oxygen concentration by volume of 30% or even 35%.

Other ways of over-oxygenating the flame 57 produced by the burner 16 will now be described with reference to FIGS. 5 to 7.

Figure 5:
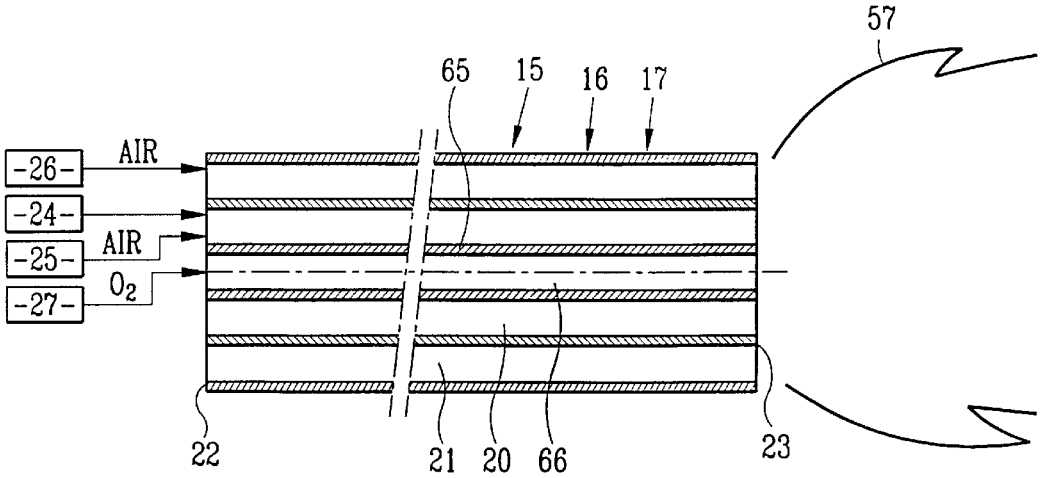

In the embodiment of FIG. 5, the injector 17 comprises an oxygen injection lance 65 arranged inside the passage 20, which is now of annular cross section.

The lance 65 has an interior passage 66 of circular cross section which is connected, in the region of the inlet 22 of the injector 17, to the source 27 of oxygen.

The passages 20 and 21 are connected respectively to the sources 24, 25 and 26.

This embodiment makes it possible to create, within the flame 57, a stable pilot flame which very quickly heats the fuel from the source 24 up to its ignition temperature.

Figure 6:
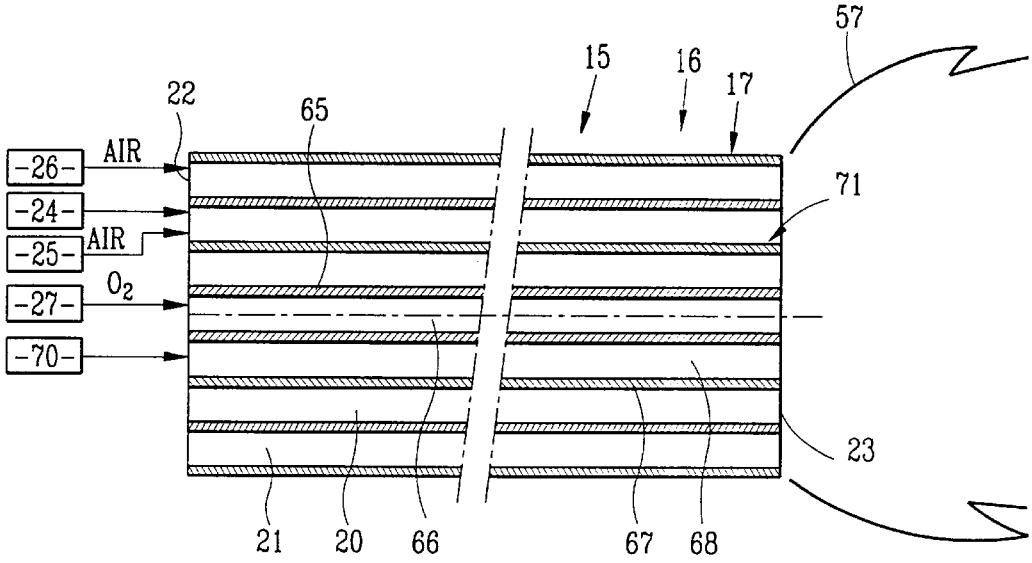

The embodiment of FIG. 6 differs from that of FIG. 5 in that a tube 67 is arranged around the lance 65 to create a further passage 68 between the passage 66 of the oxygen-injecting lance 65 and the passage 20.

The passage 68, of annular cross section, is connected, in the region of the inlet 22 of the injector 17, to a source 70 of natural gas, which is a high-quality fuel.

The passages 66 and 68 thus form an auxiliary natural gas/oxygen burner actually within the burner 16.

The auxiliary burner 71, located radially on the inside of the burner 16, produces a pilot flame with better properties than the one in the embodiment of FIG. 5.

Figure 7:
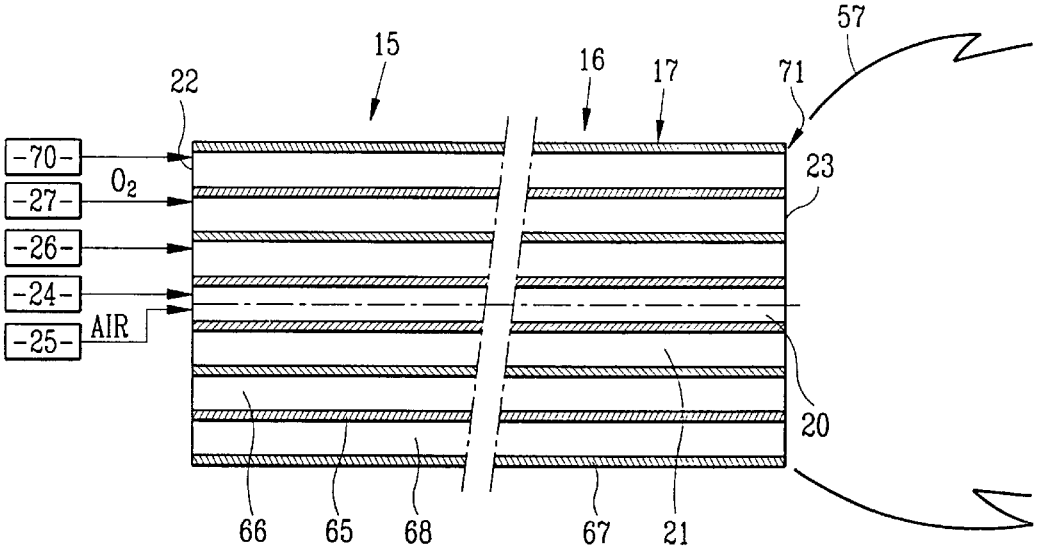

The embodiment of FIG. 7 differs from that of FIG. 6 in that the auxiliary burner 71 is arranged radially on the outside of the burner 16. Specifically, the passage 66, now of annular cross section, externally surrounds the passage 21, while the passage 68 externally surrounds the passage 66.

The pilot flame produced by the burner 71 is then located radially on the outside of the flame 57.

The various embodiments and alternative forms of FIGS. 2 to 7 can be combined in the region of the heating means 15.

In general, the oxygen flow rate has to be between 2 and 20 $m^3/h$ (STP) per MW (megawatt) of theoretical power supplied by complete combustion of the fuel(s) injected by the heating means 15.

This oxygen has to be supplied by an oxygen rich fluid with an oxygen content higher than that of air, and injected into the fuel-injection zone of the heating means 15.

This injection of oxygen-rich fluid may be by means of a carrier fluid which carries a fuel injected by the heating means 15. This fuel may be a high or low quality fuel and in the form of a fluid, that is to say liquid and/or gaseous, or in solid form.

As far as the heating means 7 are concerned, a number of other embodiments will now be described.

Figure 8:
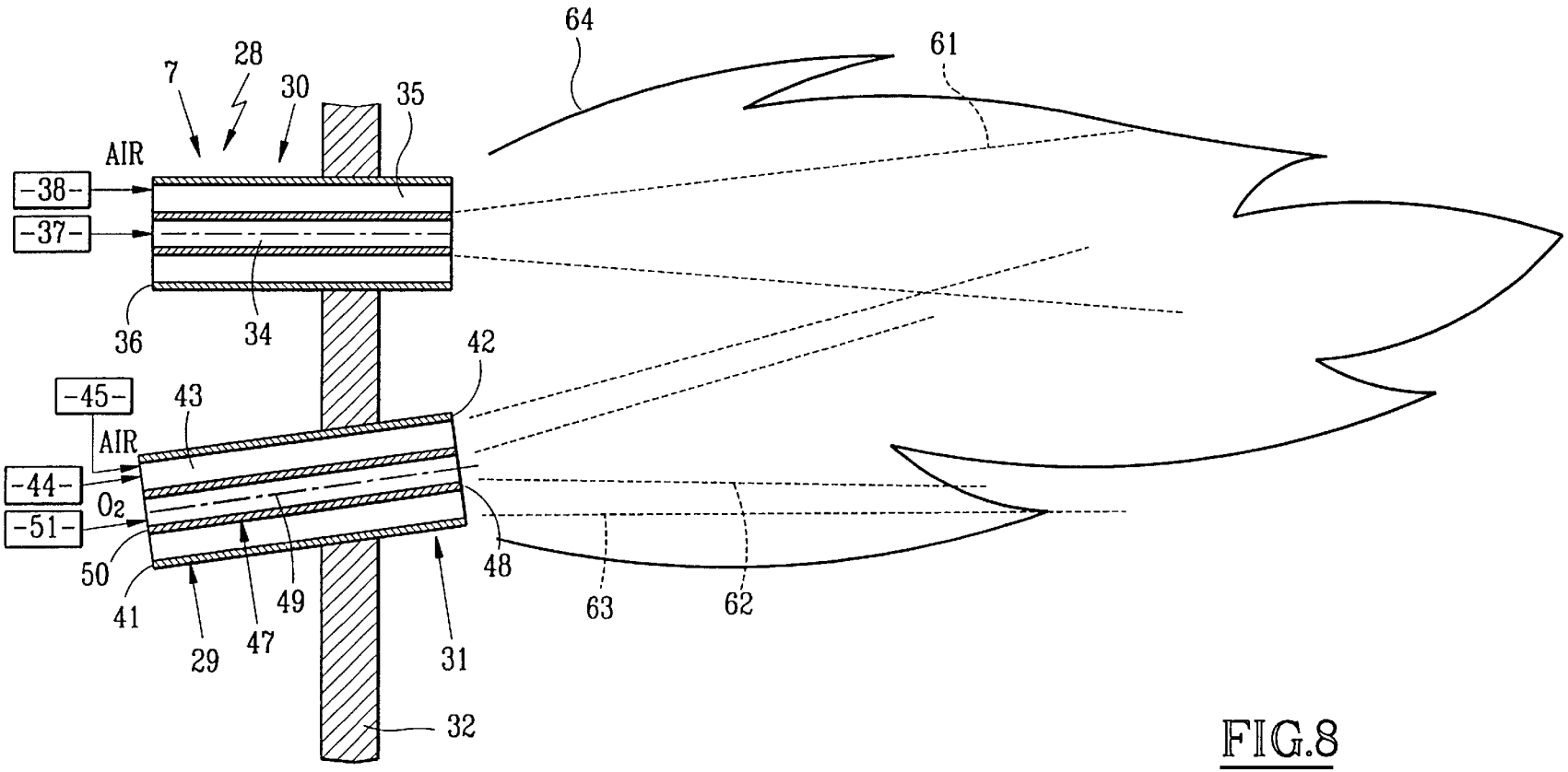
FIGS. 8 and 9 are views similar to FIG. 3, illustrating other embodiments of the invention.

FIG. 8 illustrates a second embodiment of the heating 7, in which the lance 47 is arranged inside the injector 31, coaxial therewith, and forms part of this injector 31 and therefore part of the burner 29.

The passage 43 therefore has an annular cross section and the oxygen-injection zone 62 is located at the heart of the waste water injection zone 63.

The oxygen from the source 51 is therefore injected toward the fuel-injection zone 61 with an angle of convergence that corresponds to the angle of inclination of the lance 47 to the horizontal, that is to say an angle smaller than 25°.

This second embodiment makes it possible to limit the amount of oxygen injected by the lance 47 as a result of the fact that this oxygen is injected right at the heart of the waste water. This second embodiment is particularly intended to increase the amount of waste water incinerated.

Figure 9:
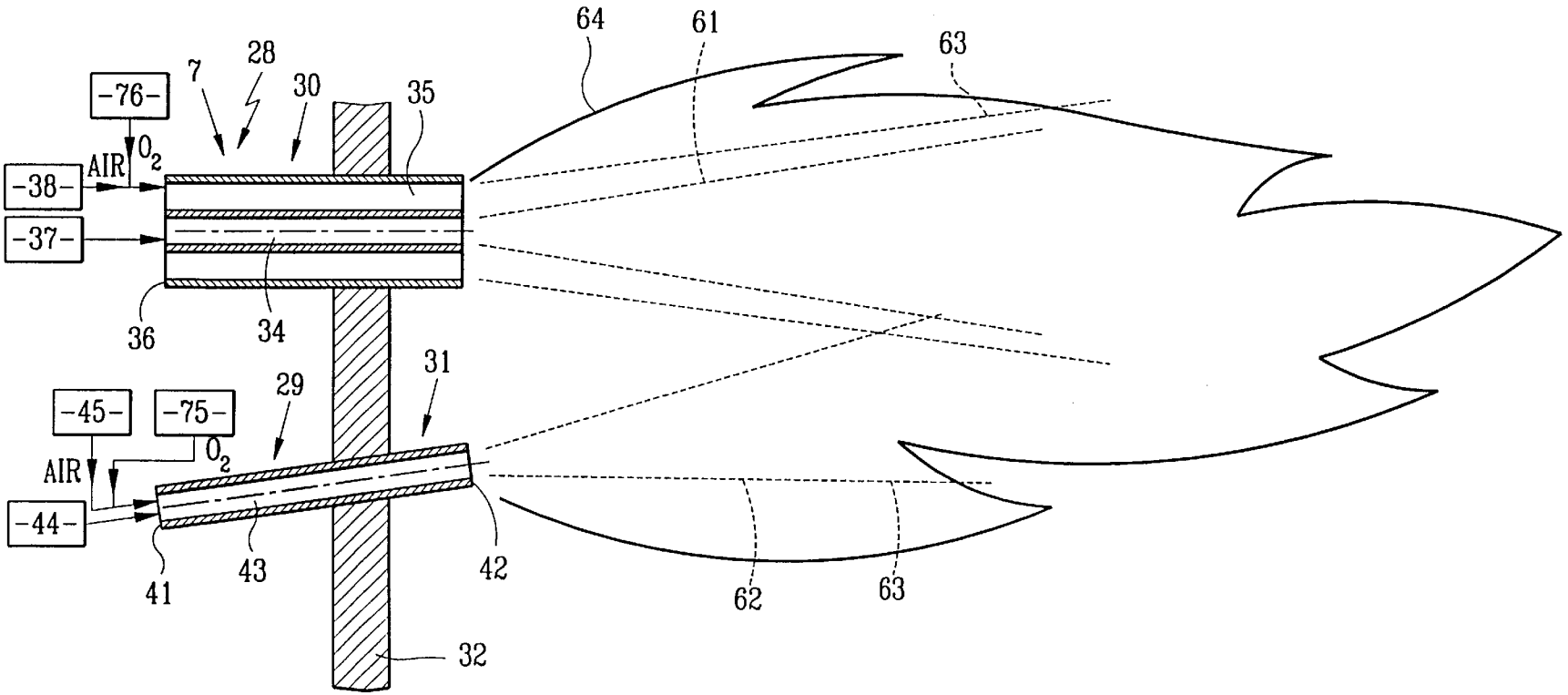

FIG. 9 illustrates a third embodiment of the heating means 7 in which the lance 47 is omitted and the over-oxygenation at the region of the flame 64 is provided:

by enriching the air sprayed out from the source 45 with oxygen from a source 75, and by enriching the air from the source 38 with oxygen from a source 76.

Thus, an oxygen-injection zone 63 surrounds the fuel-injection zone 61 at the outlet of the injector while an oxygen-injection zone 63 coincides with a fuel-injection zone 62 at the outlet of the injector 31.

The purity of the oxygen from the sources 75 and 76 is, for example, higher than 90%.

Figure 10:
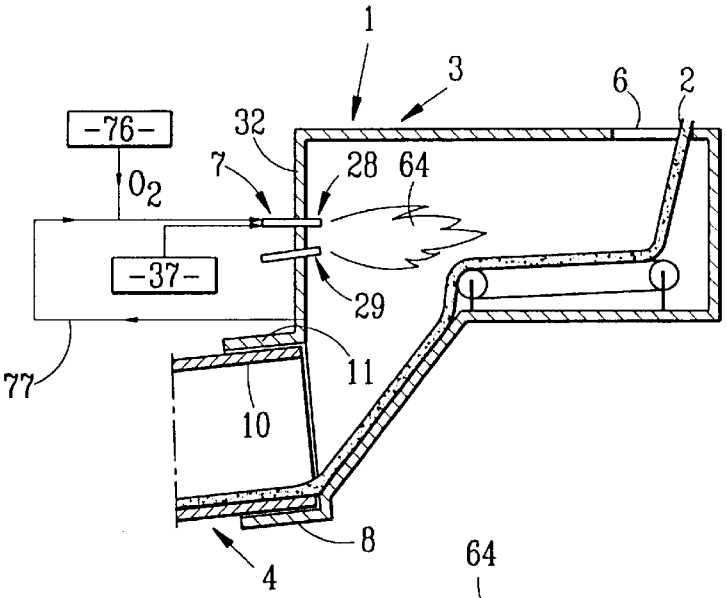
FIG. 10 is a partial diagrammatic view of the precalcination device illustrating an alternative form of the embodiment of FIG. 9.

In an alternative form of this embodiment, and illustrated diagrammatically in FIG. 10, the air source 38 has been replaced by a pipe 77 for drawing off flue gases or products of combustion from the rotary kiln 4. This pipe 77 draws off these flue gases from a region downstream of the precalcination device 3 to form, with the oxygen from the source 76, the oxidizer for the fuel from the source 38.

The feeds to the burner 29 have not been depicted in this FIG. 10.

Figure 11:
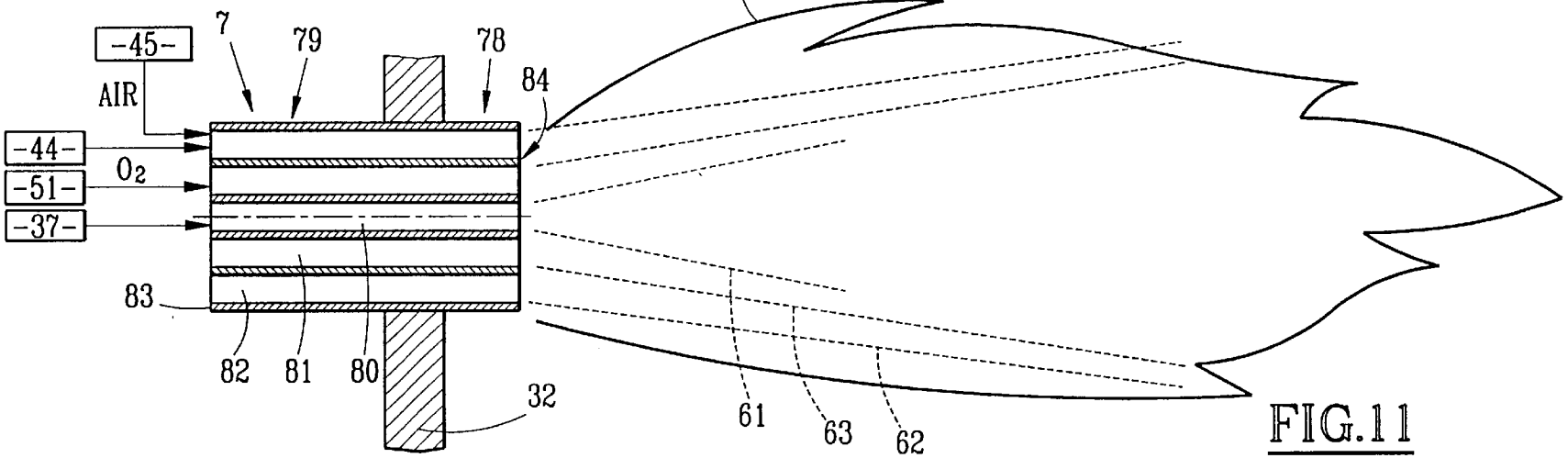
FIG. 11 is a view similar to FIG. 3 illustrating another embodiment of the invention.

FIG. 11 illustrates a fourth embodiment of the heating means 7, in which the burners 28, 29 and the lance 47 of FIG. 3 are replaced by a single burner 78, the injector 79 of which is located with its axis horizontal. The injector 79, borne by the wall 32, comprises an inner passage 80, of circular cross section, surrounded externally by an intermediate passage 81 of annular cross section, itself externally surrounded by an outer passage 82 of annular cross section.

The inner passage 80 is connected, at the inlet 83 of the injector 79, to the source 37 of natural gas.

The passage 81 is connected, at the inlet 83 of the injector 79, to the source 51 of oxygen and the passage 82 is connected, at the inlet 83, both to the source 44 of waste water and to the source 45 of sprayed-out air.

This fourth embodiment makes it possible to ensure a good mixing of all the fuels and oxidizers introduced into the injector 79 and to limit the bulk of the heating means 7.

In fact, in this embodiment, the passages 80 and 81 form an auxiliary natural gas/oxygen burner 84 within the burner 78 to produce a pilot flame at the outlet of the injector 79.

The embodiments and alternative forms described with reference to FIGS. 3 and 8 to 11 can be combined in terms of the heating means 7.

In general, it is considered that an oxygen-rich fluid with an oxygen concentration by volume higher than that of the flue gases or products of combustion from the rotary kiln 4 and which pass through the precalcination device needs to be introduced so that this oxygen-rich fluid can provide between 1 and 40%, and preferably between 1 and 10%, of the oxygen needed for the combustion brought about by the heating means 7.

The products of combustion from the rotary kiln may supply 60 to 99% of the stoichiometric amount of oxygen needed for this combustion.

The oxygen-rich fluid may be obtained by mixing some of the products of combustion, the oxygen concentration by volume of which is between 1 and 4%, with a more oxygen-rich fluid, for example air, with oxygen-enriched air and/or with oxygen with a purity higher than 88%.

As a preference, the amount of oxygen-rich fluid introduced will be such that the adiabatic temperature of the flame 64 produced by the heating means 7 is higher than 1000° C. and preferably higher than 1250° C.

More generally, the over-oxygenation may be provided only at the heating means 7 or at the heating means 15. Thus, the burner 16 of the heating means 15 may be supplied only with fuel and with air which has not been over-oxygenated or with some other oxidizer.

In this case, over-oxygenation is provided at the heating means 7 by injecting an oxygen-rich fluid near the fuel-injection zones of the heating means 7.

This over-oxygenation may make it possible to limit unburnt matter, including unburnt matter from the heating means 15.

This scenario is particularly suited to increasing the amount of low-quality fuel incinerated. Specifically, it has been found that the constraints imposed in the region of the precalcination device 3 on the production process are mainly thresholds relating to temperature and to unburnt matter which can easily be observed with over-oxygenation, which means that large quantities of low-quality fuel can be incinerated at the precalcination device 3.

Conversely, over-oxygenation can be provided only at the heating means 15 that are fed with at least one low-quality fuel.

More generally, the process according to the invention can be applied to processes for treating materials in which an ore-based material is decarburized. Thus, the process according to the invention may apply to the manufacture of limestone or dolomite.

What is claimed is:

1. A process for calcining an ore-based material comprising the steps:

passing the material through a precalcination device equipped with at least one fuel injector to produce at least partially calcined material;

supplying the at least one fuel injector of the precalcination device with at least one fuel so as to form a fuel-injection zone at the outlet of the at least one fuel injector;

supplying the at least one fuel injector of the precalcination device with oxidizing agent comprising the products of combustion from a rotary kiln located downstream of the precalcination device with respect to the direction in which the material flows;

thereafter passing the at least partially calcined material into the rotary kiln, the rotary kiln including a primary combustion unit at a downstream end of the rotary kiln;

injecting at least one oxygen-rich fluid near to the fuel-injection zone, the oxygen-rich fluid having an oxygen concentration by volume that is higher than that of the products of combustion from the rotary kiln which pass through the precalcination device so that the oxygen-rich fluid supplies from 1% to 40% of the stoichiometric amount of oxygen needed for the combustion of the fuel injected by the fuel injector.

2. (Amended) The process as claimed in claim 1, wherein 60% to 99% of the stoichiometric amount of oxygen needed for the combustion of the fuel are provided by the products of combustion from the rotary kiln.

3. The process as claimed in claim 1, wherein the oxygen concentration by volume of the products of combustion from the rotary kiln is greater than or equal to 1%.

4. The process as claimed in claim 1, wherein the oxygen-rich fluid comprises a mixture of some of the products of combustion and a gas containing at least about 20% oxygen.

5. The process as claimed in claim 4, further comprising:

drawing off some of the products of combustion and;

mixing air, oxygen-enriched air, industrially pure oxygen with a concentration higher than about 88%, or combinations thereof, with the products of combustion drawn off in the step of drawing off.

6. The process as claimed in claim 1, wherein the adiabatic temperature of the flame produced at the outlet of the fuel injector is higher than 1000° C.

7. The process as claimed in claim 6, wherein the adiabatic temperature of the flame produced at the outlet of the fuel injector is higher than 1250° C.

8. The process as claimed in claim 1, wherein the step of supplying fuel to the at least one fuel injector comprising supplying a low-quality fuel.

9. The process as claimed in claim 1, wherein the step of injecting oxygen-rich fluid comprises injecting with an oxygen-rich-fluid injector which is distinct from the fuel injector.

10. The process as claimed in claim 9, wherein the distance between the outlet of said oxygen-rich-fluid injector and the outlet of the fuel injector is less than about 50 times the interior width of the oxygen-rich-fluid injector.

11. The process as claimed in claim 1, wherein the step of injecting an oxygen-rich fluid comprises injecting toward the fuel-injection zone of the at least one fuel injector.

12. The process as claimed in claim 11, wherein the step of injecting fuel comprises injecting using the at least one fuel injector and injecting the oxygen-rich fluid at an angle of convergence of less than 25°.

13. The process as claimed in claim 1, wherein the at least one fuel injector of the precalcination device comprises at least two fuel injectors which are, the step of supplying fuel comprises supplying the at least two fuel injectors with at least one fuel to form a fuel-injection zone at outlets of the at least two fuel injectors; and the step of injecting comprises injecting at least one oxygen-rich fluid with an oxygen concentration by volume that is higher than that of the products of combustion from the rotary kiln near to the fuel-injection zones of said at least two fuel injectors.

14. The process as claimed in claim 1, further comprising injecting at least one oxygen-rich fluid with an oxygen concentration by volume higher than that of the products of combustion from the rotary kiln with a fuel injector belonging to the precalcination device.

15. The process as claimed in claim 14, wherein the step of injecting said oxygen-rich fluid with an injector of the precalcination device comprises injecting the oxygen-rich fluid as a carrier fluid for carrying a fuel into said fuel injector of the precalcination device.

16. The process as claimed in claim 14, wherein the oxygen-rich fluid is oxygen with a purity greater than 90% that is passed through said fuel injector of the precalcination device via an oxygen-specific passage.

17. The process as claimed in claim 16, further comprising introducing a high-quality fuel through a passage of said fuel injector of the precalcination device near to an oxygen-specific passage so as to form a pilot flame at the outlet of said fuel injector.

18. The process as claimed in claim 1, wherein the at least one oxygen-rich fluid comprises oxygen-enriched air.

19. The process as claimed in claim 1, wherein the at least one oxygen-rich fluid has an oxygen concentration higher than 90%.

20. The process as claimed in claim 1, further comprising:

injecting an oxygen-rich fluid with an oxygen concentration higher than that of air into a fuel-injection zone of the primary combustion unit of the rotary kiln.

21. The process as claimed in claim 20, wherein the step of injecting oxygen-rich fluid into a fuel-injection zone of the rotary kiln comprises injecting inside a fuel injector belonging to the primary combustion unit of the rotary kiln.

22. The process as claimed in claim 21, wherein the oxygen-rich fluid injected in the step of injecting oxygen-rich fluid into a fuel-injection zone of the rotary kiln is oxygen with a purity greater than 90% that is passed through said fuel injector via an oxygen-specific passage.

23. The process as claimed in claim 22, wherein an oxygen-specific passage is located radially on the inside of said fuel injector of the rotary kiln.

24. The process as claimed in claim 22, wherein an oxygen-specific passage is located radially on the outside of said fuel injector of the rotary kiln.

25. The process as claimed in claim 22, comprising introducing at least one high-quality fuel through a passage of said fuel injector near to an oxygen-specific passage to form a pilot flame at the outlet of said fuel injector of the rotary kiln.

26. The process as claimed in claim 21, comprising:

producing at least one fuel flow and at least one air flow in said fuel injector of the rotary kiln; and enriching at least one air flow, at least one fuel flow, or both, in said fuel injector of the rotary kiln, with oxygen.

27. The process as claimed in claim 26, comprising:

producing a fuel flow in said fuel injector of the rotary kiln by introducing a fuel and a carrier fluid for the fuel into the fuel injector; and enriching the fuel flow through the fuel injector of the rotary kiln with oxygen by enriching the carrier fluid with oxygen.

28. The process as claimed in claim 27, wherein the step of producing a fuel flow by introducing a fuel and a carrier fluid comprises introducing said fuel into said injector in the form of a fluid.

29. The process as claimed in claim 27, wherein the step of producing a fuel flow by introducing a fuel and a carrier fluid comprises introducing said fuel into said injector in the form of solid particles.

30. The process as claimed in claim 27, wherein the step of enriching comprising enriching the carrier fluid with oxygen until it has an oxygen concentration up to 35%.

31. The process as claimed in claim 26, wherein said fuel of the at least one fuel flow is a low-quality fuel.

32. The process as claimed in claim 20, wherein the step of injecting an oxygen-rich fluid with an oxygen concentration higher than that of air into a fuel-injection zone of the primary combustion unit comprises introducing oxygen into the fuel-injection zone of the primary combustion unit of the rotary kiln with a flow rate of between 2 and 20 $m^3/h$ per MW of theoretical power supplied by a complete combustion of the fuel injected by the primary combustion unit.

33. The process as claimed in claim 1, wherein the material is selected to form clinker.

34. The process as claimed in claim 2, wherein the oxygen concentration by volume of the products of combustion from the rotary kiln is greater than or equal to 1%.

35. The process as claimed in claim 2, wherein the oxygen-rich fluid comprises a mixture of some of the products of combustion and a gas containing at least about 20% oxygen.

36. The process as claimed in claim 35, further comprising:

drawing off some of the products of combustion and;

mixing air, oxygen-enriched air, industrially pure oxygen with a concentration higher than about 88%, or combinations thereof, with the products of combustion drawn off in the step of drawing off.

37. The process as claimed in claim 2, wherein the adiabatic temperature of the flame produced at the outlet of the fuel injector is higher than 1000° C.

38. The process as claimed in claim 37, wherein the adiabatic temperature of the flame produced at the outlet of the fuel injector is higher than 1250° C.

39. The process as claimed in claim 2, wherein the step of supplying fuel to the at least one fuel injector comprising supplying a low-quality fuel.

40. The process as claimed in claim 2, wherein the step of injecting oxygen-rich fluid comprises injecting with an oxygen-rich-fluid injector which is distinct from the fuel injector.

41. The process as claimed in claim 2, wherein the step of injecting an oxygen-rich fluid comprises injecting toward the fuel-injection zone of the at least one fuel injector.

42. The process as claimed in claim 41, wherein the step of injecting fuel comprises injecting using the at least one fuel injector and injecting the oxygen-rich fluid at an angle of convergence of less than 25°.

43. The process as claimed in claim 2, wherein the at least one fuel injector of the precalcination device comprises at least two fuel injectors, the step of supplying fuel comprises supplying the at least two fuel injectors with at least one fuel to form a fuel-injection zone at outlets of the at least two fuel injectors; and the step of injecting comprises injecting at least one oxygen-rich fluid with an oxygen concentration by volume that is higher than that of the products of combustion from the rotary kiln near to the fuel-injection zones of said at least two fuel injectors.

44. The process as claimed in claim 2, further comprising injecting at least one oxygen-rich fluid with an oxygen concentration by volume higher than that of the products of combustion from the rotary kiln with a fuel injector belonging to the precalcination device.

45. The process as claimed in claim 44, wherein the step of injecting said oxygen-rich fluid with an injector of the precalcination device comprises injecting the oxygen-rich fluid as a carrier fluid for carrying a fuel into said fuel injector of the precalcination device.

46. The process as claimed in claim 2, wherein the at least one oxygen-rich fluid comprises oxygen-enriched air.

47. The process as claimed in claim 2, wherein the at least one oxygen-rich fluid has an oxygen concentration higher than 90%.

48. The process as claimed in claim 2, further comprising:

injecting an oxygen-rich fluid with an oxygen concentration higher than that of air into a fuel-injection zone of the primary combustion unit of the rotary kiln.

49. The process as claimed in claim 48, wherein the step of injecting oxygen-rich fluid into a fuel-injection zone of the rotary kiln comprises injecting inside a fuel injector belonging to the primary combustion unit of the rotary kiln.

50. The process as claimed in claim 49, wherein the oxygen-rich fluid injected in the step of injecting oxygen-rich fluid into a fuel-injection zone of the rotary kiln is oxygen with a purity greater than 90% that is passed through said fuel injector via an oxygen-specific passage.

51. The process as claimed in claim 50, wherein an oxygen-specific passage is located radially on the inside of said fuel injector of the rotary kiln.

52. The process as claimed in claim 50, wherein an oxygen-specific passage is located radially on the outside of said fuel injector of the rotary kiln.

53. The process as claimed in claim 2, wherein the material is selected to form clinker.

54. The process as claimed in claim 1, wherein the step of injecting comprises supplying from 1% to 10% of the stoichiometric amount of oxygen needed for the combustion of the fuel injected by the fuel injector.

* * * * *